US011873062B2

(12) United States Patent
Ledoux et al.

(10) Patent No.: US 11,873,062 B2
(45) Date of Patent: Jan. 16, 2024

(54) FLOATING FLUID LOADING/OFFLOADING STRUCTURE MOORED IN A BODY OF WATER, RELATED INSTALLATION, METHOD AND PROCESS

(71) Applicant: TOTAL SE, Courbevoie (FR)

(72) Inventors: Alain Ledoux, Pau (FR); Benoit Grovel, Pau (FR)

(73) Assignee: TOTAL SE, Courbevoie (FR)

( * ) Notice: Subject to any disclaimer, the term of this patent is extended or adjusted under 35 U.S.C. 154(b) by 434 days.

(21) Appl. No.: 17/291,721

(22) PCT Filed: Nov. 6, 2018

(86) PCT No.: PCT/IB2018/001405

§ 371 (c)(1),
(2) Date: May 6, 2021

(87) PCT Pub. No.: WO2020/095084

PCT Pub. Date: May 14, 2020

(65) Prior Publication Data

US 2022/0009595 A1 Jan. 13, 2022

(51) Int. Cl.
*B63B 21/50* (2006.01)
*B63B 25/12* (2006.01)
(Continued)

(52) U.S. Cl.
CPC ..... *B63B 21/50* (2013.01); *B63B 25/12* (2013.01); *B63B 27/34* (2013.01); *B63B 35/44* (2013.01);
(Continued)

(58) Field of Classification Search
CPC ..... B63B 21/50; B63B 25/12; B63B 27/34; B63B 35/44; B63B 2021/505; B63B 2035/448
See application file for complete search history.

(56) References Cited

U.S. PATENT DOCUMENTS 10,676,160 B2 * 6/2020 Atallah ..... B63B 21/50
2020/0055569 A1 * 2/2020 Atallah ..... B63B 21/50

FOREIGN PATENT DOCUMENTS

CN 106114762 A 11/2016
FR 2 920 753 A1 3/2009
(Continued)

OTHER PUBLICATIONS

International Search Report issued in corresponding International Patent Application No. PCT/IB2018/001405 dated Jun. 26, 2019.

*Primary Examiner* — S. Joseph Morano
*Assistant Examiner* — Jovon E Hayes
(74) *Attorney, Agent, or Firm* — TROUTMAN PEPPER HAMILTON SANDERS LLP

(57) ABSTRACT

The structure comprises a hull extending longitudinally along a longitudinal hull axis, a mooring equipment, comprising a first group of mooring lines connected to an anchor on the bottom of the body of water, the mooring lines of the first group protruding laterally beyond a first side of the hull, opposite the second side of the hull. The mooring equipment comprises a second group of mooring lines protruding laterally beyond the second side, and connected to an anchor located away from the second side on the bottom of the body of water. The mooring lines of the first group are connected on the first side of the hull, the space facing a second lateral wall of the hull being free of mooring lines.

20 Claims, 4 Drawing Sheets

(51) Int. Cl.
*B63B 27/34* (2006.01)
*B63B 35/44* (2006.01)

(52) U.S. Cl.
CPC ... *B63B 2021/505* (2013.01); *B63B 2035/448* (2013.01)

(56) References Cited

FOREIGN PATENT DOCUMENTS

| | | | |
|---|---|---|---|
| WO | 99/02394 | A1 | 1/1999 |
| WO | 02/060750 | A1 | 8/2002 |
| WO | 2006/101395 | A1 | 9/2006 |
| WO | 2009/067539 | A1 | 5/2009 |

* cited by examiner

FLOATING FLUID LOADING/OFFLOADING STRUCTURE MOORED IN A BODY OF WATER, RELATED INSTALLATION, METHOD AND PROCESS

CROSS REFERENCE TO RELATED APPLICATION

The present application is a U.S. National Phase Application under 35 U.S.C. § 371 of International Patent Application No. PCT/IB2018/001405, filed Nov. 6, 2018. The entire contents of which are hereby incorporated by reference.

FIELD OF THE INVENTION

The present invention concerns a floating fluid loading/offloading structure moored in a body of water, having

- a hull extending longitudinally along a longitudinal hull axis, the hull comprising a bottom wall, a first lateral wall on a first side of the hull, a second lateral wall on a second side of the hull, opposite the first side, each of the bottom wall, first lateral wall, and second lateral wall, being placed in contact with the body of water;
- a mooring equipment, comprising a first group of mooring lines connected to an anchor on the bottom of the body of water, the mooring lines of the first group protruding laterally beyond the first side, opposite the second side,
- the mooring equipment comprising a second group of mooring lines protruding laterally beyond the second side, opposite from the first side, and connected to an anchor located away from the second side on the bottom of the body of water;

Such a floating structure is for example a Floating Storage and Regasification Unit (FSRU) able to receive liquid natural gas (LNG) from a LNG tanker and to gasify the LNG to form a natural gas to be exported onshore.

In variant, the floating structure is a Floating Liquefied Natural Gas unit (FLNG) able to receive natural gas from a reservoir and to liquefy the natural gas to form LNG.

In another variant, the floating structure is a Floating Production Storage and Offloading unit (FPSO) intended to receive fluid produced from the bottom of the body of water for processing the hydrocarbons.

BACKGROUND OF THE INVENTION

Such structures can be spread moored i.e. moored with mooring lines at least at the four corners of the hull. The mooring lines protrude from the hull away to the bottom of the body of water into which they are anchored.

Such structures are relatively easy to anchor. They are moreover very stable. Nevertheless, these structures are not entirely satisfactory. The structures cannot be easily freed from their mooring equipment, in case the atmospheric conditions become inappropriate for fluid offloading. Moreover, when the loading/offloading of the fluid has to be carried out side by side with a ship, the mooring lines prevent access of the ship in the vicinity of the hull.

To overcome this problem, WO2006/101395 discloses a floating structure which is moored totally underwater. Mooring lines extend from the bottom wall of the hull to the bottom of the body of water.

Nevertheless, underwater mooring is quite complex. The connection of the mooring lines to the hull requires using specific equipment, divers and/or ROV to put in place the mooring lines. Similarly, specific equipment, divers and/or ROV must also be used to disconnect the mooring lines in case of necessity.

The underwater mooring requires many specific equipment and structural modifications on the hull. Hence, it is not very economical and it makes the structure not easily disconnectable.

One aim of the invention is therefore to provide a floating fluid loading/offloading structure which is robustly moored on the bottom of the body of water, but which remains easily disconnectable and economically attractive, while allowing an easy approach of a loading/offloading ship close to the structure.

SUMMARY OF THE INVENTION

To this aim, the subject-matter of the invention is a floating fluid loading/offloading structure of the above-mentioned type, characterized in that the mooring lines of the first group are connected above the surface of the body of water on the first side of the hull, the space facing the second lateral wall being free of mooring lines.

The floating structure according to the invention may comprise one or more of the following features, taken alone or according to any technical feasible combination:

- the mooring lines of the second group are connected apart from the second side of the hull,
- the mooring lines of the second group are connected underwater on the bottom wall, laterally apart from the second lateral wall,
- the mooring equipment comprises a pad eye, protruding below the bottom wall, the second group of mooring lines being connected to the pad eye,
- the mooring lines of the second group of mooring lines are connected on the first side of the hull, at least a bent section of each mooring line of the second group of mooring lines passing along the first lateral wall and below the bottom wall,
- the mooring equipment comprises at least a bending shoe fixed on the first lateral wall and/or on the bottom wall, the bent section being received in the bending shoe,
- the mooring equipment comprises at least an underwater stopper fixed on the first lateral wall and/or on the bottom wall, and a slotted pipe connected to the underwater stopper,
- the hull defines a first hull end and a second hull end, the first group of mooring lines comprises at least one first mooring line extending from the first hull end, the first mooring line making an angle comprised between 0° and 90° with the longitudinal hull axis in projection in a horizontal plane, the first group of mooring lines comprising at least one second mooring line at the second hull end, the second mooring line making an angle comprised between 90° and 180° with the longitudinal hull axis, in projection in a horizontal plane,
- the hull defines a first hull end and a second hull end, the second group of mooring lines comprises at least one first mooring line extending from the first hull end, the first mooring line making an angle comprised between 270° and 360° with the longitudinal hull axis in projection in a horizontal plane, the first group of mooring lines comprising at least one second mooring line at the second hull end, the second mooring line making an angle comprised between 180° and 270° with the longitudinal hull axis, in projection in a horizontal plane, the mooring equipment comprises at least a tensioning winch placed on the hull, each mooring line of the first group being able to be connected to at least one of the tensioning winch, the mooring equipment comprising at least a deck stopper for each mooring line of the first group, each mooring line is a rope and/or a chain, and the hull comprises at least a fluid processing unit, the hull being preferably a FSRU, a FLNG and/or a FPSO.

The invention also relates to a fluid loading/offloading installation comprising:

at least a fluid collecting and/or distributing structure;

a fluid loading/offloading structure as defined above;

at least a pipe connecting the fluid collecting and/or distributing structure to the fluid loading/offloading structure, the pipe extending from the first side of the fluid loading/offloading structure to the fluid collecting and/or distributing structure.

The fluid loading/offloading installation according to the invention may comprise one or more of the following features, taken alone or according to any technical feasible combination:

the fluid collecting and/or distributing structure is chosen among a floating platform such as spread moored barge, a fixed platform such as a jacket and/or an underwater structure such as a PLEM or a PLET and, the pipe is a flexible pipe.

The invention also concerns a method of installing a floating fluid loading/offloading structure moored in a body of water comprising the following steps:

providing a hull extending longitudinally along a longitudinal hull axis, the hull comprising a bottom wall, a first lateral wall on a first side of the hull, a second lateral wall on a second side of the hull, opposite the first side, each of the bottom wall, first lateral wall, and second lateral wall being placed in contact with the body of water;

providing a mooring equipment, comprising a first group of mooring lines connected to an anchor on the bottom of the body of water, the mooring lines of the first group protruding laterally beyond the first side, opposite the second side, the mooring equipment comprising a second group of mooring lines protruding laterally beyond the second side, opposite from the first side, and connected to an anchor located away from the second side and;

characterized by connecting the mooring lines of the first group above the surface of the body of water on the first side of the hull, and letting free of mooring lines the space facing the second lateral wall.

The invention also relates to a process for loading/offloading a fluid comprising the following steps:

providing a floating fluid loading/offloading structure as defined above, moored in a body of water;

placing a ship having at least a fluid reservoir along the fluid loading/offloading structure along the second side of the hull without interference with any mooring line;

advantageously mooring the ship to the floating fluid loading/offloading structure;

installing at least pipe between the floating fluid loading/offloading structure and the ship and;

conveying a fluid from the floating fluid loading/offloading structure to the ship or/and from the ship to the floating fluid loading/offloading structure.

BRIEF DESCRIPTION OF THE DRAWINGS

The invention will be better understood based on the following description, given solely as an example, and made in accordance with the appended drawings, in which.

DETAILED DESCRIPTION

Figure 1:
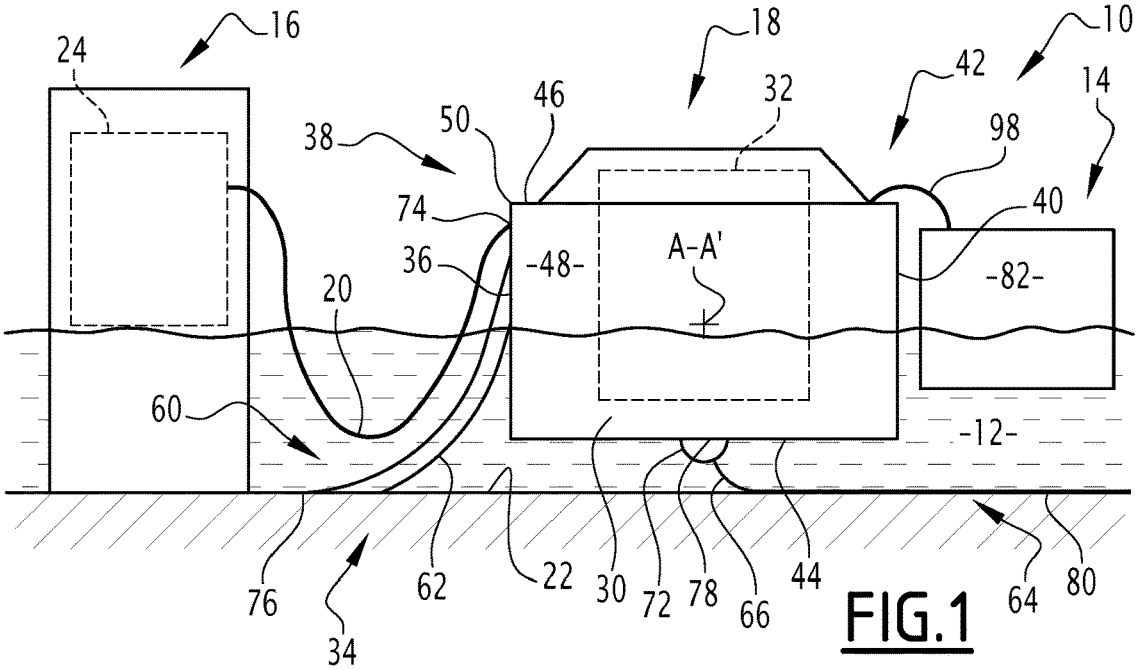
FIG. 1 is an end view of a first fluid loading/offloading installation comprising a first floating loading/offloading structure according to the invention.

A first loading/offloading installation 10 according to the invention, placed in a body of water 12, is shown schematically in FIG. 1. The installation 10 is intended to be used by at least a ship 14 to load/offload a fluid.

The fluid is for example a hydrocarbon fluid such as liquid natural gas (LNG). The liquid natural gas is intended to be transferred in the installation 10 and conveyed from the installation 10 to a network after regasification (not represented) to be used by users.

The body of water 12 is here a lake, a river, a sea, and/or an ocean. The depth of the body of water, in the vicinity of the installation is comprised between 15 m and 150 m.

The loading/offloading installation 10 here comprises a fluid collecting and/distributing structure 16, a floating fluid loading/offloading structure 18 according to the invention, and at least a pipe 20 connecting the floating fluid loading/offloading structure 18 and the fluid collecting and/or distributing structure 16.

In the example shown in FIG. 1, the fluid collecting and/or distributing structure 16 is for example a structure fixed on the bottom 22 of the body of water 12, such as a fixed jacket.

In a variant (not shown), the fluid collecting and/or distributing structure 16 is a floating structure such as spread moored barge.

The fluid collecting and/or distributing structure for example comprises at least a fluid distributor 24 intended to collect and/or distribute a fluid from the pipe 20 to an external network.

The floating fluid offloading/loading structure 18 comprises a hull 30, floating at the surface of the body of water 12, at least a fluid processing unit 32, carried by the hull 30 and a mooring equipment 34 able to moor the hull 30 at a specific position in the body of water 12.

In this example, the floating fluid loading/offloading structure 18 is a FSRU (Floating Storage and Regasification Unit). The fluid processing unit 32 comprises at least a regasification unit able to transform liquid natural gas into a gas form.

In a variant (not shown), the floating fluid loading/offloading structure 18 is a FLNG (Floating Liquefied Natural Gas), intended to receive fluid gaseous hydrocarbons produced from the bottom of the body of water to produce LNG. The fluid processing unit 32 comprises a liquefying unit able to liquefy natural gas into LNG.

In another variant (not shown), the floating fluid loading/offloading structure 18 is a FPSO (Floating Production Storage and/offloading) intended to collect liquid and gaseous hydrocarbons from the bottom of the body of water 12. The fluid processing unit 32 is then a purification and treatment unit of the liquid and gaseous hydrocarbons.

Figure 2:
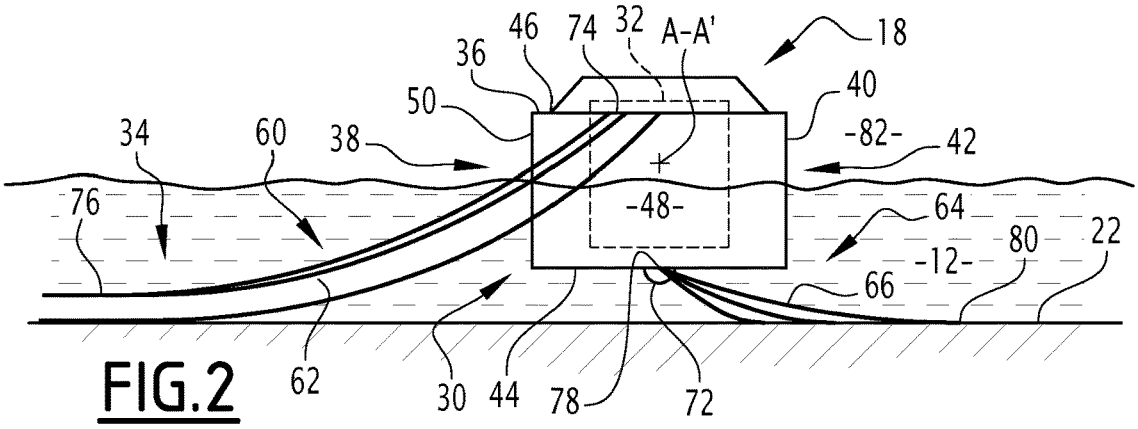
FIG. 2 is a detailed view of the mooring of the floating structure of FIG. 1.
Figure 3:
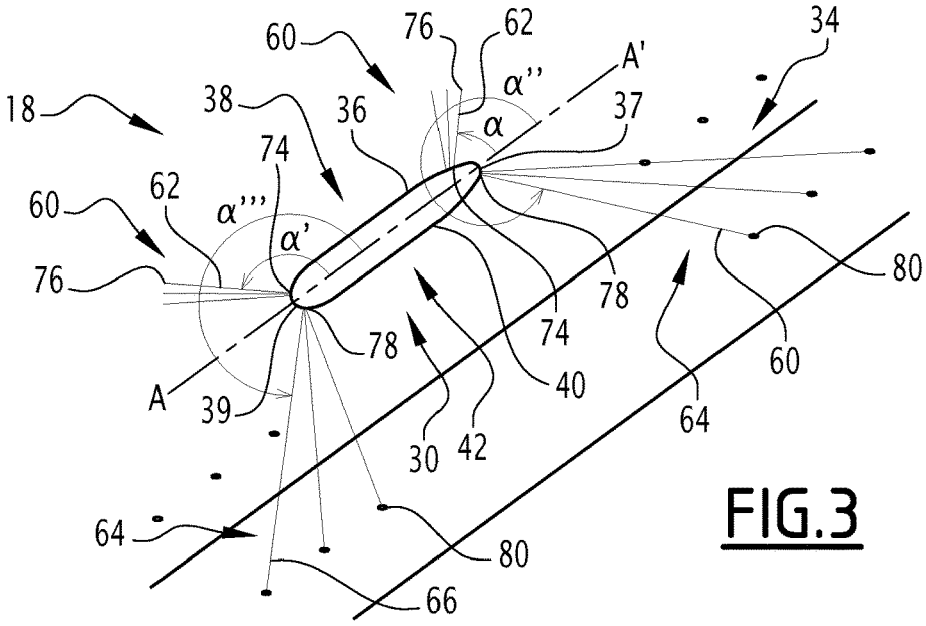
FIG. 3 is a top view of the floating structure of FIG. 2.

As shown in FIG. 3, the hull 30 extends longitudinally along a longitudinal hull axis A-A', between a first hull end 37 and a second hull end 39. In reference to FIGS. 1 to 3, the hull 30 comprises at least a first lateral wall 36 on a first side 38 of the hull 30, and a second lateral wall 40 on a second side 42 of the hull 30.

The hull 30 comprises a bottom wall 44, located below the first lateral wall 36 and the second lateral wall 40, and at least a deck 46. The first lateral wall 36, and the second lateral wall 40 are partially immersed in the body of water 12.

The first lateral wall 36 and the first side 38 are located facing the fluid collecting and/or distributing structure 16.

The second wall 40 and the second side 42 are located opposite the fluid collecting and/or distributing structure 16. The ship 14 is able to approach the hull 30 on the second side 42 and to moor to the hull 30 along the second side 42, as it will be described later.

The first lateral wall 36 and the second lateral wall 40 are partially in contact with the body of water 12. They define the most exterior surface of the hull 30 on their respective side 38, 42.

The bottom wall 44 connects the first lateral wall 36 to the second lateral wall 40. The bottom wall 44 is totally immersed in the body of water 12, below the surface. In the figures, the bottom wall 44 is represented flat, however it can be of any shape.

The first lateral wall 36, the second lateral wall 40 and the bottom wall 44 together define an inner space 48 of the hull 30, which is upwardly closed by the deck 46.

The deck 46 is here located above the surface of the body of water 12. It for example comprises a guard-rail at its periphery 50.

The fluid processing unit 32, as described above, is located on the deck 46 and/or in the inner space 48. It advantageously comprises at least a fluid reservoir and fluid processing equipment, such as pumps, evaporators, heat exchanger, separators, compressors . . . .

The first side 38 of the hull 30 is generally delimited inwards by a vertical plane containing the longitudinal axis A-A', downwards by the bottom wall 44, and outwards by the first lateral wall 36.

The second side 42 of the hull 30 is generally delimited inwards by a vertical plane containing the longitudinal axis A-A', downwards by the bottom wall 44, and outwards by the second lateral wall 40.

The mooring equipment 34 comprises a first group 60 of mooring lines 62, extending laterally apart from the hull 30 from the first side 38, and a second group 64 of mooring lines 66, extending laterally apart from the hull 30, away from the second side 42 of the hull 30.

The mooring equipment 34 further comprises, for the mooring lines 62 of the first group 60, at least a tensioning winch 68 and for each mooring line 62, at least a deck stopper 70.

The mooring equipment 34 comprises, for the mooring lines 66 of the second group 64, at least a pad eye 72 connected to the bottom wall 44 of the hull 30, or to the first lateral wall 36 and apart from the second lateral wall 40.

Each mooring line 62 of the first group 60 extends in a catenary shape from a first point 74 located above the surface of the body of water 12 on a first side 38 of the longitudinal axis A-A' to a second point 76 anchored in the bottom 22 of the body of water 12, laterally away from the first lateral wall 36 on the first side 38 of the hull 30. Each mooring line 62 extends facing the first lateral wall 36 away from the first lateral wall 36.

Each mooring line 62 is preferably formed of a rope and/or of a chain.

The first point 74 of each mooring line 62 is preferably located on the deck 46, and is maintained on the deck 46 with a deck stopper 70. The second point 76 is preferably provided with an anchor inserted in the bottom 22 of the body of water 12.

At least the mooring line 62, preferentially at least three mooring lines 62, extend from a first point 74 located in the vicinity of the first hull end 37.

The second point 76 of each mooring line 62 extending from the vicinity of the first hull end 37 protrudes away from the hull 30 beyond the first end 37, in projection on the longitudinal axis A-A'.

Preferably, in projection in a horizontal plane (see FIG. 3), each mooring line 62 in the vicinity of the first hull 37 is inclined with regard to the longitudinal axis A-A' and defines an angle $\alpha$ with the longitudinal axis A-A'. The angle $\alpha$ is preferentially comprised between 0° and 90°, preferably between 30° and 60°.

At least one mooring line 62, preferentially at least three mooring lines 62, also extends from a first point located in the vicinity of the second hull end 39.

The second point 76 of each mooring line 62 extending from the vicinity of the second hull end 39 protrudes away from the hull 30 beyond the second end 39 in projection on the longitudinal axis A-A'.

Preferably, in projection in a horizontal plane (see FIG. 3), each mooring line 62 in the vicinity of the second hull end 39 is inclined with regard to the longitudinal axis A-A' and defines an angle $\alpha'$ with the longitudinal axis A-A'. The angle $\alpha'$ is preferentially comprised between 90° and 180°, preferably between 120° and 150°.

Each mooring line 66 of the second group 64 extends in a catenary shape from a first point 78 located below the surface of water, away from the second lateral wall 40 and from the first lateral wall 36, to a second point 80 anchored in the bottom 22 of the body of water 12, laterally away from the second lateral wall 40 on the second side 42 of the hull 30.

Each mooring line 66 is preferably formed of a rope and/or of a chain.

Preferentially, the first point 78 of each mooring line 66 is connected to the pad eye 72, below the bottom wall 44, laterally away from the second lateral wall 40. The second point 80 is preferably provided with an anchor inserted in the bottom 22 of the body of water 12.

At least the mooring line 66, preferentially at least three mooring lines 66, extend from a first point 78 located in the vicinity of the first hull end 37.

The second point 80 of each mooring line 66 extending from the vicinity of the first hull end 37 protrudes away from the hull beyond the first hull end 37, in projection on the longitudinal axis A-A'.

Preferably, in projection in an horizontal plane (see FIG. 3), each mooring line 66 in the vicinity of the first hull end 37 is inclined with regard to the longitudinal axis A-A' and defines an angle $\alpha''$ with the longitudinal axis A-A'. The angle $\alpha''$ is preferentially comprised between 270° and 360°, preferably between 300° and 330°.

At least one mooring line 66, preferentially at least three mooring lines 66, extend from a second point 80 located in the vicinity of the second hull end 39.

The second point 80 of each mooring line 66 extending from the vicinity of the second hull end 39 protrudes away from the hull 30 beyond the second hull end 39, in projection on the longitudinal axis A-A'.

Preferably, in projection in a horizontal plane (see FIG. 3), each mooring line 66 is inclined with regard to the longitudinal axis A-A' and defines an angle $\alpha'''$ with the longitudinal axis A-A'. The angle $\alpha'''$ is preferentially comprised between 180° and 270°, preferably between 210° and 240°.

Each mooring line 66 of the second group 64 extends to a second point 80 located away from the hull 30 beyond the second lateral wall 40 on the bottom of the body of water 12.

Hence, each mooring line 62 of the first group 60 protrudes away from the hull 30 on the first side of the hull 38, and each mooring line 66 of the second group 64 protrudes away beyond the second lateral wall 40 of the hull 30.

The first point 78 and the second point 80 of each second mooring line 66 are located below the body of water 12.

Hence, the space 82 located facing the second lateral wall 40 away from the hull 30 is free of mooring lines 66. The space 82 is therefore totally available for the approach and mooring of a ship 14, without interference with any mooring lines and the ship 14.

Figure 5:
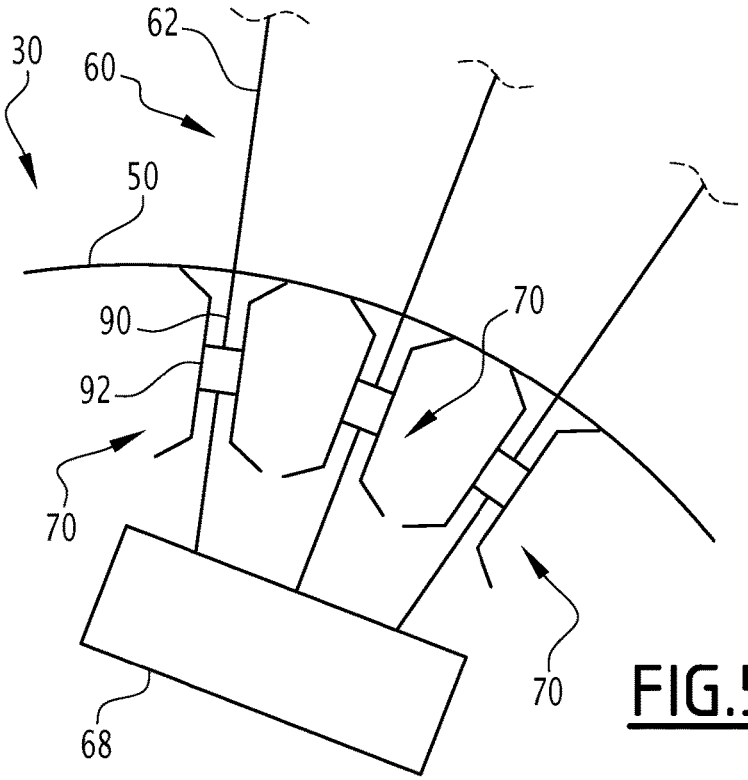
FIG. 5 is a schematic top view of deck stoppers and winch adapted to the mooring of at least a group of mooring lines of the structure of FIG. 2.

In reference to FIG. 5, the tensioning winch 68 is preferably located on or above the deck 46. It is able to seize at least a part of each mooring line 62 to tension it, before the mooring line 62 is blocked in the deck stopper 70.

The deck stopper 70 comprises a channel 90 receiving and guiding each mooring line 66, and a blocker 92 selectively operable between an inactive configuration, in which the mooring line 66 is free to translate in the channel 90, and a blocking configuration, in which the mooring line 62 is blocked in the channel 90.

Preferentially, the mooring equipment 34 comprises at least a pad eye 72 located in the vicinity of the first hull end 37, and at least a pad eye 72, located in the vicinity of the second hull end 39.

Figure 4:
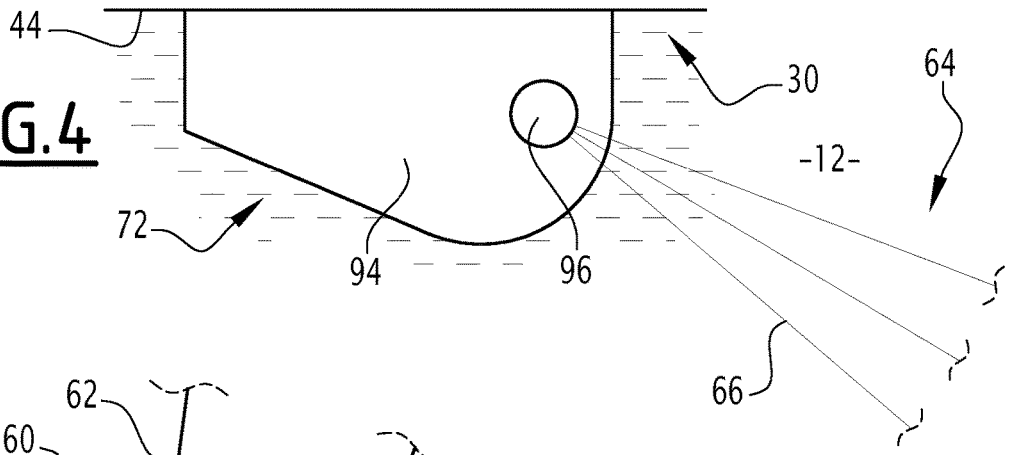
FIG. 4 is a view of a bottom pad eye, fixed to the bottom wall of the hull in the floating structure of FIG. 2.

In the example of FIG. 4, the pad eye 72 comprises at least a partition 94 fixed to the bottom wall 44 and protruding down from the bottom wall 44 and at least an eyelet 96 in which one mooring line 66 of the second group 64 is fixed.

As shown in FIG. 1, the pipe 20 connects at least a fluid processing unit 32 on the floating fluid loading/loading structure 18 to an equipment on the fluid collecting and/or distributing structure 16.

In the example of FIG. 1, the pipe has a U-shape. It is partially immersed in the body of water. Its ends are connected respectively to the floating fluid loading/loading structure 18 and to the fluid collecting and/or distributing structure 16 above the surface of water.

The ship 14 is able to position itself in the space 82 facing the second wall 40. It is able to be moored to the hull 30. The hull 30 and/or the ship 14 are equipped with a discharging equipment comprising at least a fluid conveying element 98 such as but not limited to a marine loading arm of hose, a pipe, a hose, or/and a riser.

The set-up of the loading/offloading installation 10 will be now briefly described. Initially, a first point 78 on a first section of each mooring line 66 of the second group 64 is attached underwater to the pad eye 72.

A second section of each mooring line 66 of the second group 64 is laid on the bottom of the body of water 12 and it is anchored at a second point 80 on the bottom of the body of water 12, at a position defined above.

Then, the respective free ends of the first section and of the second section of each mooring line 66 are connected together. The mooring line 66 then adopts a catenary shape.

Subsequently, each mooring line 62 of the first group 60 is laid in the body of water 12 and is anchored at its second point 76 in the bottom 22 of the body of water 12. A buoy (not shown) is placed around the first point 74 of each mooring line 62.

Then, the free end of each mooring line 62 of the first group 60 is pulled by the tensioning winch 68 to be inserted into the deck stopper 70 in its inactive configuration. When the mooring line 62 is sufficiently tensioned so that the hull 30 occupies its nominal position, the blocker 92 of the corresponding deck stopper 70 is activated and the first point 74 of each mooring line 62 of the first group 60 is blocked on the deck 46.

In use, a ship 14 containing fluid, in particular a LNG tanker, can freely approach the hull 30 on the second side 42, without interfering with mooring lines 66 or with any other mooring equipment 34. The ship 14 preferentially adopts an orientation parallel to the longitudinal axis A-A' of the hull 30. The hull 30 and the ship 14 are then placed side by side. Then, the ship 14 is advantageously moored to the hull 30 and the fluid conveying element 98 is put in place.

In the example of a FSRU, the fluid, preferentially LNG, circulates from the ship 14 reservoir to the fluid processing unit 32, to be loaded in a reservoir of the fluid processing unit 32. Then, the fluid is evaporated and is conveyed towards the fluid collecting and/or distributing structure 16 through the pipe 20.

When the ship 14 has discharged all the required fluid, it is able to move away from the hull 30 without interference with mooring lines 62.

Thanks to the invention, the connection/disconnection of the hull 30 to its mooring equipment 34 is very simple to carry out, since all the mooring lines 62 of the first group 60 located on the first side 38 can easily be connected/disconnected from the surface. Only the mooring lines 66 of the second group 64 must be disconnected from under water. Moreover, there is no interference between the ships 14 intended to load/unload the fluid and the hull 30, allowing a safe and efficient approach of the ship towards the hull 30.

Figure 6:
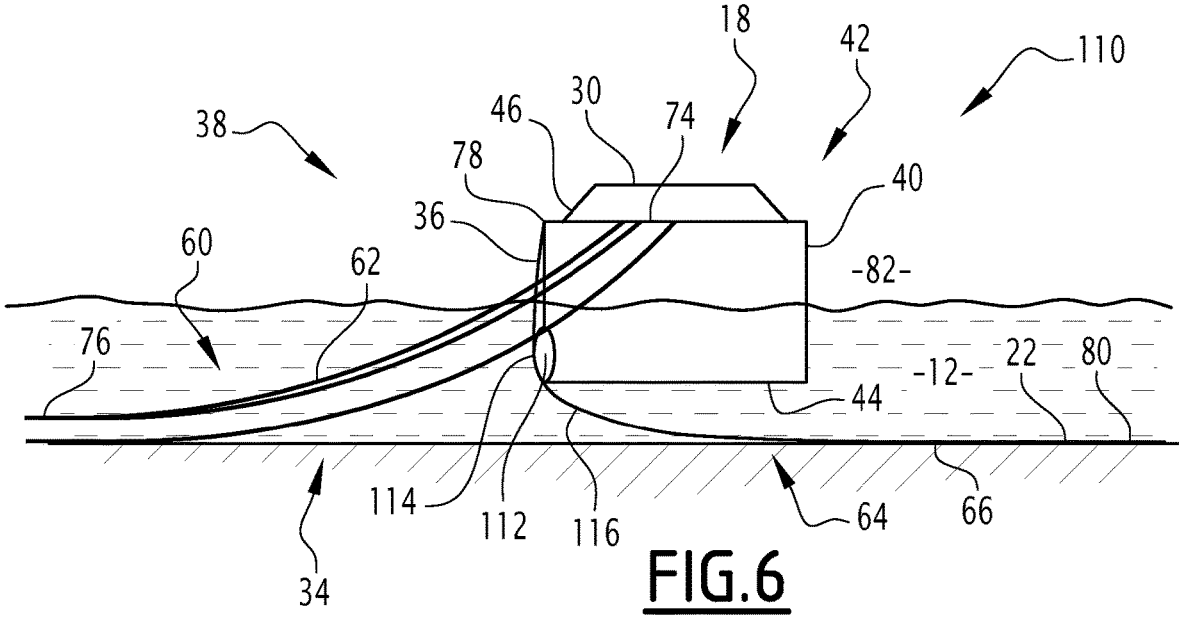
FIG. 6 is a view similar to FIG. 2 of a second floating loading/offloading installation according to the invention.
Figure 7:
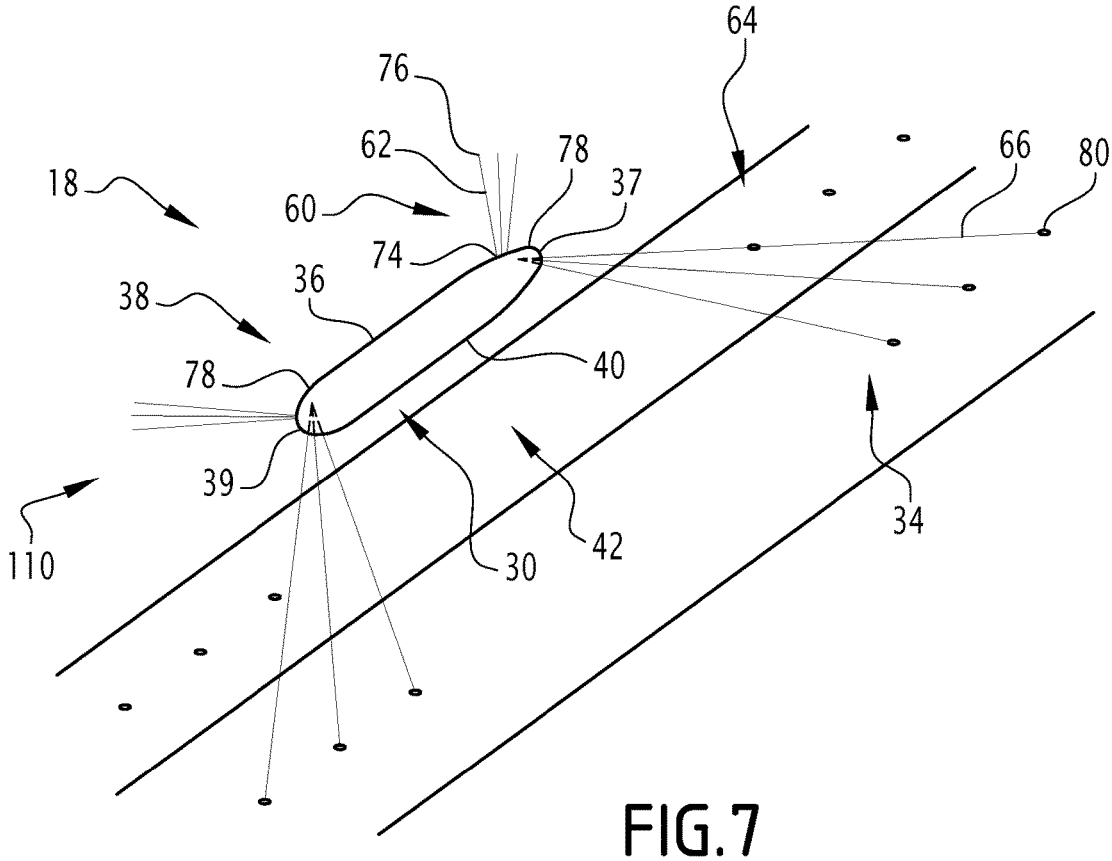
FIG. 7 is a top view of the structure of FIG. 6.

A second installation 110 according to the invention is shown in FIGS. 6 and 7.

The second installation 110 differs from the first installation 10 by the configuration of the second group 64 of mooring lines 66.

Each mooring line 66 of the second group 64 is connected to the hull 30 at a first point 78 located on the first side 38 of the hull 30. The first point 78 is preferentially located on the deck 46, above the surface of the body of water 12.

The mooring equipment 34 of the second installation 110 further differs from the mooring equipment 34 of the first installation 10 in that it comprises a deck stopper 70 for each mooring line 66 of the second group 64, in addition to the deck stopper 70 for each mooring line 62 of the first group 60.

Moreover, the mooring equipment 34 comprises a tensioning winch 68 which can be specific to the mooring lines 66 of the second group 64, or which can be the same as the mooring lines 62 of the first group 60.

Preferentially, the mooring equipment 34 further comprises, for each mooring line 66 of the second group 64, a bending shoe 112 fixed on the first lateral wall 36 and/or on the bottom wall 44, in the vicinity of the transition between the first lateral wall 36 and the bottom wall 44.

The bending shoe 112 provides an external guiding surface 114 onto which each mooring line 66 of the second group 64 is able lay. The guiding surface 114 has a controlled radius of curvature, e.g. comprised between 1 m and 10 m.

Hence, each mooring line 66 of the second group 64 has a bent section 116 extending from the first point 78 downwardly along the first lateral wall 36 to the bending shoe 112, from the bending shoe 112 below the bottom wall 44, and beyond the second lateral wall 40 to the second point 78.

As in the first installation 10, the space 82 located facing the second lateral wall 40 is therefore free of mooring lines 66.

The setup of the second installation 110 is particularly easy, since it does not require the use of a diver to connect the mooring lines 66 of the second group 64. As for the mooring lines 62 of the first group 60, the mooring lines 66 of the second group 64 are laid in the water, with a buoy at the first point 78. Then, the hull 30 is passed above the mooring lines 66 of the second group 64. The free ends of the mooring lines 66 are pulled to the deck 46 on the first side 38 of the longitudinal axis A-A', advantageously by using a tensioning winch 68.

Each mooring line 66 of the second group 64 is inserted in the channel 90 of a deck stopper 70 with the blocker 92 in the inactive configuration and is progressively tensioned. When the tensioning of the mooring line 66 is sufficient, the blocker 92 is activated to block the first point 78 of the mooring line in the channel 90.

Thereafter, the mooring lines 62 of the first group 60 are put in place, as described above for the first installation 10.

The second installation 110 according to the invention is therefore very easy to connect or disconnect.

Figure 9:
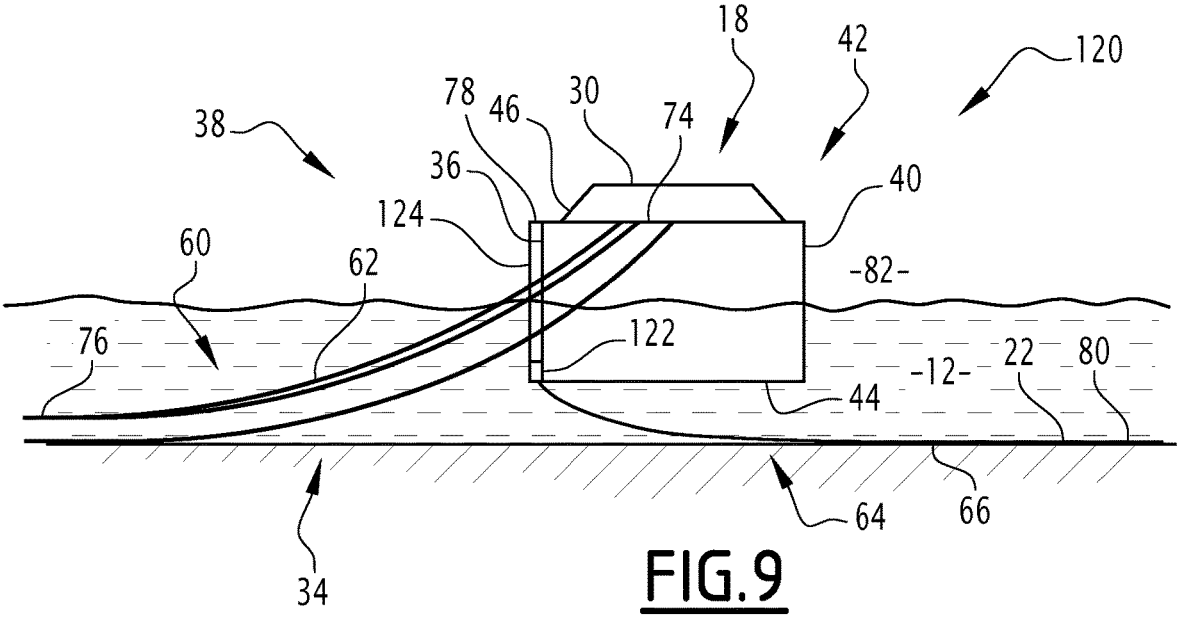
FIG. 9 is a view similar to FIG. 2 of a third floating loading/offloading installation according to the invention.
Figure 10:
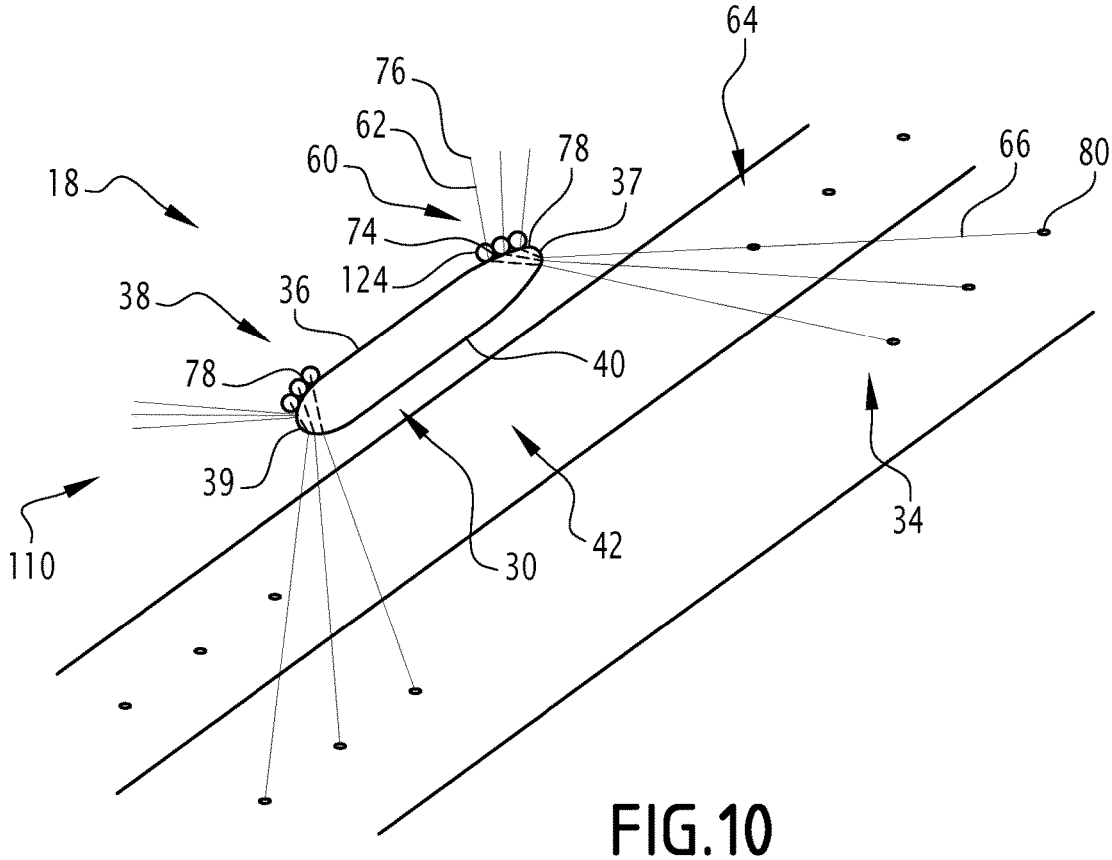
FIG. 10 is a top view of the structure of FIG. 9.

A third installation 120 according to the invention is shown in FIGS. 9 and 10.

The third installation 120 differs from the first installation 10 by the configuration of the second group 64 of mooring lines 66.

Each mooring line 66 of the second group 64 is connected to the hull 30 at an underwater stopper 122 located on the first side 38 or the bottom side 40 of the hull 30. The first point 78 is preferentially located on the deck 46, above the surface of the body of water 12.

The mooring equipment 34 of the third installation 122 further differs from the mooring equipment 34 of the first installation 10 in that it comprises a split pipe 124 for each mooring line 66 of the second group 64, connected to the underwater stopper 122. The split pipe 124 guides the first chain link i.e. the chain link at first point 78 on each mooring line 66 of the second group to its position in the underwater stopper 122.

Moreover, the mooring equipment 34 comprises a tensioning winch 68 which can be specific to the mooring lines 66 of the second group 64, or which can be the same as the mooring lines 62 of the first group 60.

As in the first installation 10, the space 82 located facing the second lateral wall 40 is therefore free of mooring lines 66.

The setup of the third installation 120 is particularly easy, since it does not require the use of a diver to connect the mooring lines 66 of the second group 64. As for the mooring lines 62 of the first group 60, the mooring lines 66 of the second group 64 are laid in the water, with a buoy at the first point 78. Then, the hull 30 is passed above the mooring lines 66 of the second group 64. The free ends of the mooring lines 66 are pulled to the deck 46 on the first side 38 of the longitudinal axis A-A', advantageously by using a tensioning winch 68.

Each first link of the mooring line 66 of the second group 64 is inserted in a corresponding split pipe 124 sliding towards the underwater stopper 122.

Thereafter, the mooring lines 62 of the first group 60 are put in place, as described above for the first installation 10.

The third installation 120 according to the invention is therefore very easy to connect or disconnect with decreased risk of chain link twist compared to second installation.

Figure 8:
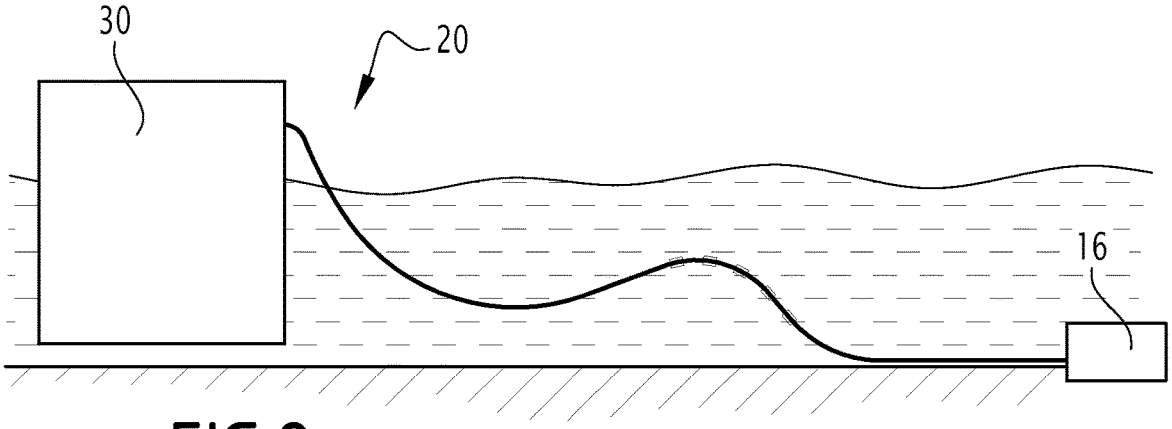
FIG. 8 is a view similar to FIG. 1 illustrating a third fluid loading/offloading installation according to the invention.

A variant of the installations 10, 110, 120 disclosed above is shown in FIG. 8. In this variant, the fluid collecting and/or distributing structure 16 is located underwater. The structure 16 is for example a pipeline end manifold (PLEM) and/or a pipeline end termination (PLET).

The pipe 20 is for example a flexible riser having as shown in FIG. 8, a wavy configuration.

The invention claimed is:

1. A floating fluid loading/offloading structure, moored in a body of water, comprising:

a hull extending longitudinally along a longitudinal hull axis, the hull comprising a bottom wall, a first lateral wall on a first side of the hull, a second lateral wall on a second side of the hull, opposite the first side, each of the bottom wall, first lateral wall, and second lateral wall, being placed in contact with the body of water;

a mooring equipment, comprising a first group of mooring lines connected to an anchor on the bottom of the body of water, the mooring lines of the first group protruding laterally beyond the first side, opposite the second side, the mooring equipment comprising a second group of mooring lines protruding laterally beyond the second side, opposite from the first side, and connected to an anchor located away from the second side on the bottom of the body of water;

wherein the mooring lines of the first group being connected above the surface of the body of water on the first side of the hull, a space being located facing the second lateral wall, the space being free of mooring lines.

2. The floating structure according to claim 1, wherein the mooring lines of the second group are connected apart from the second side of the hull.

3. The floating structure according to claim 1, wherein the mooring lines of the second group are connected underwater on the bottom wall, laterally apart from the second lateral wall.

4. The floating structure according to claim 3, wherein the mooring equipment comprises a pad eye, protruding below the bottom wall, the second group of mooring lines being connected to the pad eye.

5. The floating structure according to claim 1, wherein the mooring lines of the second group of mooring lines are connected on the first side of the hull, at least a bent section of each mooring line of the second group of mooring lines passing along the first lateral wall and below the bottom wall.

6. The floating structure according to claim 5, wherein the mooring equipment comprises at least a bending shoe fixed on the first lateral wall and/or on the bottom wall, the bent section being received in the bending shoe.

7. The floating structure according to claim 5, wherein the mooring equipment comprises at least an underwater stopper fixed on the first lateral wall and/or on the bottom wall, and a slotted pipe connected to the underwater stopper.

8. The floating structure according to claim 1, wherein the hull defines a first hull end and a second hull end, the first group of mooring lines comprising at least one first mooring line extending from the first hull end, the at least one first mooring line making an angle comprised between 0° and 90° with the longitudinal hull axis in projection in a horizontal plane, the first group of mooring lines comprising at least one second mooring line at the second hull end, the at least one second mooring line making an angle comprised between 90° and 180° with the longitudinal hull axis, in projection in a horizontal plane.

9. The floating structure according to claim 1, wherein the hull defines a first hull end and a second hull end, the second group of mooring lines comprising at least one third mooring line extending from the first hull end, the at least one third mooring line making an angle comprised between 270° and 360° with the longitudinal hull axis in projection in a horizontal plane, the first group of mooring lines comprising at least one fourth mooring line at the second hull end, the at least fourth mooring line making an angle comprised between 180° and 270° with the longitudinal hull axis, in projection in a horizontal plane.

10. The floating structure according to claim 1, wherein the mooring equipment comprises at least a tensioning winch placed on the hull, each mooring line of the first group of mooring lines being configured to be connected to the at least one the tensioning winch, the mooring equipment comprising at least a deck stopper for each mooring line of the first group of mooring lines.

11. The floating structure according to claim 1, wherein each mooring line is a rope and/or a chain.

12. The floating structure according to claim 1, wherein the hull comprises at least a fluid processing unit.

13. A fluid loading/offloading installation comprising:

at least a fluid collecting and/or distributing structure;

a fluid loading/offloading structure according to claim 1;

at least a pipe connecting the fluid collecting and/or distributing structure to the fluid loading/offloading structure, the pipe extending from the first side of the fluid loading/offloading structure to the fluid collecting and/or distributing structure.

14. The fluid loading/offloading installation according to claim 1, wherein the fluid collecting and/or distributing structure is chosen among a floating platform, a fixed platform and/or an underwater structure.

15. The fluid loading/offloading installation according to claim 13, wherein the pipe is a flexible pipe.

16. A method of installing a floating fluid loading/offloading structure moored in a body of water comprising:

providing a hull extending longitudinally along a longitudinal hull axis, the hull comprising a bottom wall, a first lateral wall on a first side of the hull, a second lateral wall on a second side of the hull, opposite the first side, each of the bottom wall, first lateral wall, and second lateral wall being placed in contact with the body of water;

providing a mooring equipment, comprising a first group of mooring lines connected to an anchor on the bottom of the body of water, the mooring lines of the first group protruding laterally beyond the first side, opposite the second side, the mooring equipment comprising a second group of mooring lines protruding laterally beyond the second side, opposite from the first side, and connected to an anchor located away from the second side;

connecting the mooring lines of the first group above the surface of the body of water on the first side of the hull, providing a space facing the second lateral wall, and letting free of mooring lines the space facing the second lateral wall.

17. A process for loading/offloading a fluid, comprising:

providing a floating fluid loading/offloading structure according to claim 1 moored in a body of water;

placing a ship having at least a fluid reservoir along the fluid loading/offloading structure along the second side of the hull without interference with any mooring line;

installing at least pipe between the floating fluid loading/offloading structure and the ship; and conveying a fluid from the floating fluid loading/offloading structure to the ship or/and from the ship to the floating fluid loading/offloading structure.

18. The floating structure according to claim 12, wherein the hull is a FSRU, a FLNG and/or a FPSO.

19. The fluid loading/offloading installation according to claim 14, wherein the floating platform is a spread moored barge, and/or the fixed platform is a jacket and/or the underwater structure is a PLEM or a PLET.

20. The process according to claim 17, comprising mooring the ship to the floating fluid loading/offloading structure.

* * * * *